US011489248B2

(12) United States Patent
Lecerf et al.

(10) Patent No.: US 11,489,248 B2
(45) Date of Patent: Nov. 1, 2022

(54) PATCH ANTENNA FOR EQUIPPING A SPACECRAFT

(71) Applicant: ARIANEGROUP SAS, Paris (FR)

(72) Inventors: Nathalie Lecerf, Saint Aubin de Medoc (FR); Serge Villers, Le Bouscat (FR)

(73) Assignee: ARIANEGROUP SAS, Paris (FR)

( * ) Notice: Subject to any disclaimer, the term of this patent is extended or adjusted under 35 U.S.C. 154(b) by 0 days.

(21) Appl. No.: 16/962,766

(22) PCT Filed: Jan. 17, 2019

(86) PCT No.: PCT/FR2019/050095

§ 371 (c)(1),
(2) Date: Jul. 16, 2020

(87) PCT Pub. No.: WO2019/141947

PCT Pub. Date: Jul. 25, 2019

(65) Prior Publication Data

US 2020/0358171 A1 Nov. 12, 2020

(30) Foreign Application Priority Data

Jan. 19, 2018 (FR) ..... 1850443

(51) Int. Cl.
*H01Q 13/10* (2006.01)
*H01Q 1/28* (2006.01)
(Continued)

(52) U.S. Cl.
CPC ..... *H01Q 1/28* (2013.01); *H01Q 1/002* (2013.01); *H01Q 9/0407* (2013.01)

(58) Field of Classification Search
CPC ..... H01Q 1/28; H01Q 1/002; H01Q 1/40; H01Q 9/0407; H01Q 9/0428; H01Q 9/065;
(Continued)

(56) References Cited

U.S. PATENT DOCUMENTS 5,608,414 A * 3/1997 Amore ..... H01Q 21/065 343/700 MS
5,977,924 A 11/1999 Takei et al.
(Continued)

FOREIGN PATENT DOCUMENTS

EP 0598580 A1 5/1994
FR 2736213 A1 1/1997
(Continued)

OTHER PUBLICATIONS

P. Sharma et al. "Analysis and Optimized Design of Single Feed Circularly Polarized Microstrip Antennas" IEEE Transactions on Antennas and Propagation, vol. 31, No. 6, Nov. 1, 1983, pp. 949-955.

(Continued)

*Primary Examiner* — Awat M Salih
(74) *Attorney, Agent, or Firm* — Bookoff McAndrews, PLLC

(57) ABSTRACT

A patch antenna intended to equip a spacecraft, the antenna comprising a dielectric substrate, a radiating antenna element present on the dielectric substrate, the radiating antenna element having a center of symmetry and an area devoid of material, the center of symmetry being present in the area devoid of material, and a protective layer covering the radiating antenna element.

19 Claims, 2 Drawing Sheets

(51) Int. Cl.
*H01Q 1/00* (2006.01)
*H01Q 9/04* (2006.01)

(58) Field of Classification Search
CPC .. H01Q 9/0464; H01Q 9/0471; H01Q 13/106; H01Q 19/005; H01Q 21/065
See application file for complete search history.

(56) References Cited

U.S. PATENT DOCUMENTS

2006/0044188 A1* 3/2006 Tsai ..... H01Q 9/0407 343/700 MS
2006/0044191 A1* 3/2006 Harihara ..... H01Q 9/0457 343/700 MS
2016/0197406 A1* 7/2016 Hashimoto ..... H01Q 9/0457 343/848
2018/0212317 A1* 7/2018 Hutcheson ..... H01Q 1/422
2019/0097302 A1* 3/2019 Berge ..... H01Q 9/0407
2020/0227829 A1* 7/2020 Jouanlanne ..... H01Q 5/335

FOREIGN PATENT DOCUMENTS

KR 20080073568 A 8/2008
WO 03/007425 A1 1/2003
WO 2012/069492 A1 5/2012

OTHER PUBLICATIONS

French Search Report in FR Application No. 1850443 dated Aug. 22, 2018 (2 pages).
International Search Report in Application No. PCT/FR2019/050095, dated Mar. 14, 2019 (3 pages).
Diana Veronica Navarro Mendez et al., "Circular Polarization Patch Antenna with Low Axial Ratio in a Large Beamwidth", 2013 7th European Conference on Antennas and Propagation (EuCAP), pp. 3330-3333.

* cited by examiner

PATCH ANTENNA FOR EQUIPPING A SPACECRAFT

CROSS-REFERENCE TO RELATED APPLICATION(S)

This application is the U.S. national phase entry under 35 U.S.C. § 371 of International Application No. PCT/FR2019/050095, filed on Jan. 17, 2019, which claims priority to French Patent Application No. 1850443, filed on Jan. 19, 2018.

The present invention relates to a patch antenna intended to equip a spacecraft, such as a space launcher or a satellite.

BACKGROUND OF THE INVENTION

Spacecraft are equipped with antennas which provide the communication between these craft and the ground stations during the flight phases.

These antennas are in particular used for remote measurement, trajectography, or the satellite positioning system (Global Navigation Satellite System, GNSS).

Various antenna structures are known from WO 03/007425, U.S. Pat. No. 5,977,924, EP 0 598 580, WO 2012/069492 and FR 2 736 213.

It is desirable to dispose of antennas intended to equip spacecraft having a hemispherical radiation diagram in order to improve the conferred coverage.

SUBJECT AND SUMMARY OF THE INVENTION

The invention concerns, according to a first aspect, a patch antenna intended to equip a spacecraft, the antenna comprising:

- a dielectric substrate,
- a radiating antenna element present on the dielectric substrate, the radiating antenna element having a center of symmetry and an area devoid of material, the center of symmetry being present in the area devoid of material, and
- a protective layer covering the radiating antenna element.

In the remainder of the text, the expression "radiating antenna element" will be referred to as "antenna element".

The fact that an area devoid of material is positioned at the center of symmetry of the antenna element makes it possible to obtain a hemispherical radiation diagram for the antenna.

In an exemplary embodiment, the area devoid of material has a polygonal shape.

In an exemplary embodiment, the antenna element has at least two corners symmetrical to one another with respect to the center of symmetry, a first axis connecting these two corners, and the area devoid of material extending along a second axis forming an angle less than or equal to 5° with the first axis.

Such a feature makes it possible to obtain a circular polarization for the produced radiation, and therefore a reduced attenuation when it is propagated.

In particular, the second axis can form an angle less than or equal to 2° with the first axis.

Such a feature makes it possible to further reduce the attenuation of the radiation when it is propagated.

In an exemplary embodiment, the area devoid of material is a slit.

Such a feature makes it possible to obtain a hemispherical radiation diagram over a widened frequency band.

In an exemplary embodiment, the antenna element is positioned on the barycenter of the dielectric substrate.

In an exemplary embodiment, the thickness of the protective layer is less than or equal to 5 mm.

Such a feature makes it possible to minimize the protuberant nature of the antenna, and therefore to reduce still further any damage by aerothermal flows.

In an exemplary embodiment, the protective layer is directly in contact with the antenna element and the dielectric substrate.

Such a feature advantageously makes it possible to eliminate the risk of a Corona effect which could lead to a temporary loss of transmission.

In an exemplary embodiment, the protective layer is a thermal protection layer or a space radiation protection layer.

The present invention also concerns a craft equipped on its external surface with at least one antenna as described above.

In an exemplary embodiment, the craft comprises on its external surface a plurality of antenna as described above uniformly distributed over this surface.

In an exemplary embodiment, the craft is a space launcher or a satellite.

BRIEF DESCRIPTION OF THE DRAWINGS

Other features and advantages of the invention will become apparent from the following description, given by way of nonlimiting example, with reference to the appended drawings, wherein.

DETAILED DESCRIPTION OF EMBODIMENTS

Figure 1:
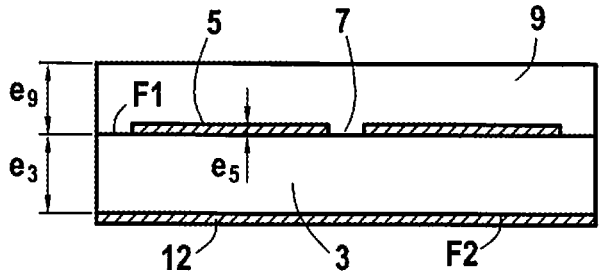
FIG. 1 is a section view, schematic and partial, of a first example of a patch antenna according to the invention.

FIGS. 1 to 4 represent a first example of a patch antenna 1 according to the invention.

The patch antenna 1 comprises a dielectric substrate 3 on which an antenna element 5 is present. The dielectric substrate 3 has a flat shape. The dielectric substrate 3 can be made of a composite material, for example of polytetrafluoroethylene (PTFE) reinforced with glass. The dielectric substrate 3 can for example be a substrate marketer under the reference code TLC30 by the company Taconic. This example represents a singlelayer substrate 3 but it does not depart from the scope of the invention when the latter is formed by a plurality of stacked layers. The thickness of the dielectric substrate 3 can for example be less than or equal to 5 mm, and for example be between 2 mm and 5 mm.

The dielectric substrate 3 can have a plurality of through openings 8 each allowing the passage of an attaching element, such as a screw. The attaching elements make it possible to attach the antenna 1 to the spacecraft. The openings 8 can be present at the corners of the dielectric substrate 3, as illustrated in FIG. 2.

The antenna element 5 is formed by metallization, for example copper metallization. The antenna element 5 has a flat shape. The thickness $e_5$ of the antenna element 5 can for example be less than or equal to 40 μm, and for example be between 15 μm and 40 μm. The antenna element 5 is present on a first face F1 of the dielectric substrate 3. The antenna element 5 can be in contact with the dielectric substrate 3.

Figure 2:
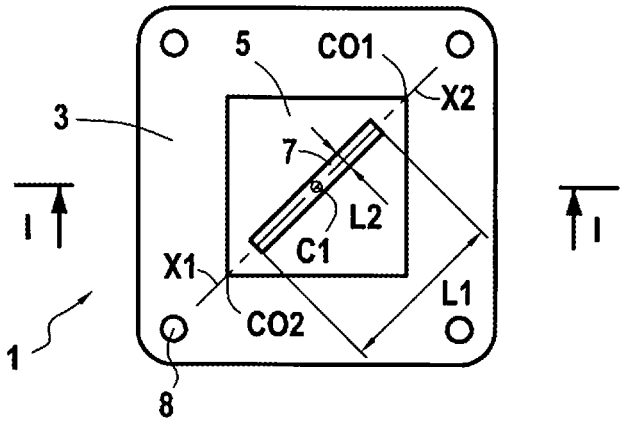
FIG. 2 is a top view of the first example of a patch antenna in a cutaway through the protective layer.
Figure 3:
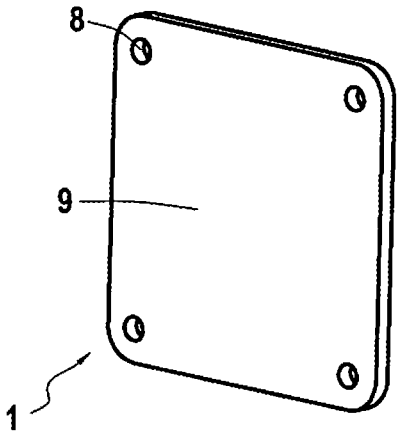
FIG. 3 is a perspective view of the first example of an antenna on the side of the protective layer.

As illustrated in FIG. 2, the antenna element 5 covers a part only of the surface of the dielectric substrate 3. FIG. 2 is a cutaway view through the protective layer 9, which can be transparent or opaque. FIG. 1, meanwhile, is a partial section view showing the antenna 1 only at the area where the antenna element 5 is present. The dielectric substrate 3 can bear a single antenna element 5. The antenna element 5 can cover the barycenter of the dielectric substrate 3. The barycenter of the dielectric substrate 3 can be a center of symmetry of this substrate 3.

A ground plane 12 is present on a second face F2 of the dielectric substrate 3, opposite the first face F1. The ground plane 12 is formed by a metallization, for example copper metallization.

Figure 4:
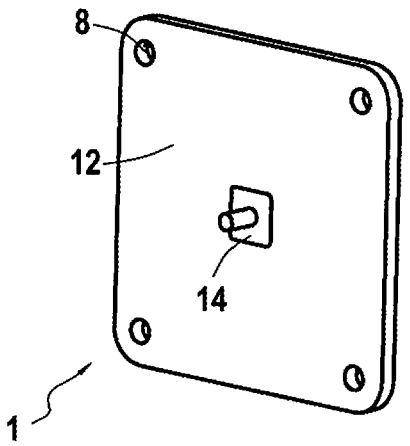
FIG. 4 is a perspective view of the first example of an antenna on the side of the ground plane.

A connector 14 is present on the second face F2 (represented in FIG. 4, not represented in FIG. 1). A coaxial power supply cable is intended to be connected to the connector 14. The dielectric substrate 3 can have a drill hole through which extends the central conductor of the connector which connects the input of the connector 14 to the antenna element 5 and which thus allows the supply of power to this antenna element 5 (drill hole and central electrical conductor not represented). The antenna element 5 is intended to emit a signal in the radio frequency spectrum.

The antenna element 5 has a center of symmetry C1. The center of symmetry C1 of the antenna element 5 can be superimposed on the center of symmetry of the dielectric substrate 3, which is the case in the illustrated example. The antenna element 5 has an area 7 devoid of material. The antenna element 5 can have a single area 7 devoid of material. The center of symmetry C1 is present in the area 7 devoid of material. The area 7 devoid of material does not have any metallic deposit. The area 7 devoid of material is symmetrical with respect to the center of symmetry C1 as illustrated. During manufacturing, the surface of the dielectric substrate 3 can be entirely covered by metallization. Then, a selective elimination is made of this metallization deposited in the area 7 and around the radiating element 5. The selective elimination made can be done through openings of a mask superimposed on the metallization produced.

The area 7 devoid of material can have a polygonal shape, and for example a rectangular shape as illustrated. In a nonillustrated variant, the area devoid of material is square in shape. The area 7 devoid of material can be a slit, as illustrated. As indicated above, this feature makes it possible to obtain a hemispherical radiation diagram over a widened frequency band, for example of approximately 90 MHz in width. The ratio of the length L1 to the width L2 (L1/L2) of the area 7 devoid of material can be greater than or equal to 5, for example 10.

The antenna element 5 can have a polygonal shape and here has a square shape. The antenna element 5 can have corners CO1 and CO2 symmetrical to one another with respect to the center of symmetry C1. The corners CO1 and CO2 can each form an apex of the antenna element 5. The corners CO1 and CO2 can each form an angle less than or equal to 90°. In the illustrated example, the corners CO1 and CO2 each form a right angle, equal to 90°.

The corners CO1 and CO2 can be connected by a first axis X1. The first axis X1 can define a diagonal of the antenna element 5. The area 7 devoid of material can extend along a second axis X2. The second axis X2 can correspond to the longitudinal axis of the area 7 devoid of material. The second axis X2 can form an angle less than or equal to 5°, for example less than or equal to 2°, with the first axis X1. In particular, the second axis X2 is, in the example illustrated in FIG. 1, colinear with the first axis X1 but it does not depart from the scope of the invention when this is not the case, as will be described below.

The protective layer 9 covers the antenna element 5 in order to protect the latter from the external environment. The protective layer 9 has a flat shape. The protective layer 9 can be made of dielectric material. The protective layer 9 covers the first face F1 of the dielectric substrate 3. The protective layer 9 can cover the entirety of the dielectric substrate 3 (see FIG. 3). The protective layer 9 can be in contact with the antenna element 5 and the dielectric substrate 3. Thus, it is possible for the antenna 1 not to have any cavity in it. The thickness $e_9$ of the protective layer 9 can be less than or equal to 5 mm.

In particular, the protective layer 9 can be a thermal protection layer or a space radiation protection layer.

The thermal protection layer can have a thermal conductivity, measured at 50° C., less than or equal to 0.3 W $m^{-1}$ $K^{-1}$, for example to 0.2 W $m^{-1}$ $K^{-1}$. By way of example of a usable thermal protection, one may cite the material marketed under the reference code "Norcoat 4000" by the company ArianeGroup.

It is possible for the material forming the space radiation protection layer not to be damaged after absorbing a dose of gamma radiation greater than or equal to 10 000 Gray, for example 15 000 Gray. Examples of a usable space radiation protection include the material marketed under the reference code PEEK GF30 by the company Ensinger or the polyimide 35N marketed by the company Arlon.

When it equips a space launcher, it is advantageous to provide the antenna with a thermal protection layer in order to protect the underlying elements from the high temperatures encountered during operation.

When it equips a satellite, it is advantageous to provide the antenna with a space radiation protection layer in order to protect the underlying elements from this radiation during operation.

Figure 5:
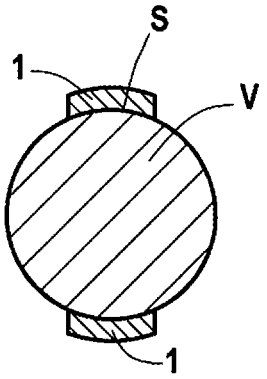
FIG. 5 represents, schematically and partially, a spacecraft equipped with two antennas according to the first example.

FIG. 5 schematically represents a spacecraft V equipped with two antennas 1 according to the first example. According to an example, the substrate 3 is flexible enough to conform to the shape of the surface S of the craft V. It is thus possible in this case to confer on the substrate 3 a nonzero curvature during its assembly on the external surface S of the craft V. The antenna 1 is in this case directly attached to the surface S without requiring the use of an additional metal sheet for adapting to the curvature of the surface of the spacecraft V. The spacecraft V can be a space launcher or a satellite. The space launcher can be used to position one or more satellites.

The antennas 1 can be uniformly distributed over the surface of the spacecraft V. The antennas can each occupy one and the same angular coverage.

Figure 6:
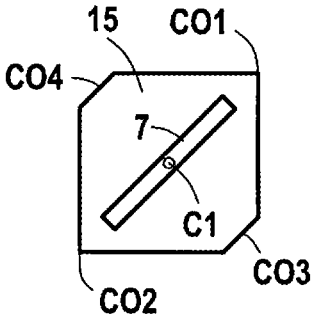
FIGS. 6 to 8 represent, schematically and partially, variants of patch antennas according to the invention.

FIG. 6 represents a variant of an antenna element 15. In this variant, the antenna element 15 only differs from the antenna element 5 in that it comprises corners CO3 and CO4 symmetrical with respect to the center C1 of symmetry which correspond to truncated apices. The antenna element 15 here has a square shape with two truncated apices CO3 and CO4. The other features described above in the context of the example of FIGS. 1 to 4 remain applicable to this exemplary embodiment.

Figure 7:
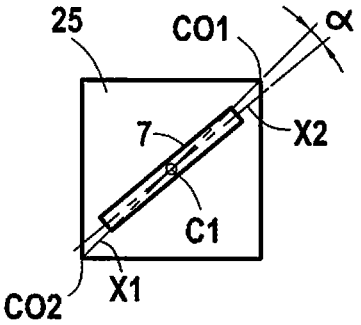

FIG. 7 represents another variant of an antenna element 25. In this variant, the antenna element 25 differs from the antenna element 5 only in that the second axis X2 forms a nonzero angle with the first axis X1, here equal to 5°. The other features described above as part of the example of FIGS. 1 to 4 remain applicable to this exemplary embodiment.

Figure 8:
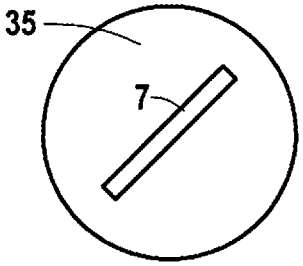

FIG. 8 represents another variant of an antenna element 35. In this variant, the antenna element 35 differs from the antenna element 5 only in that it has a circular shape and no longer a square one. The antenna element could have another shape such as an oval shape, or else a nonsquare rectangular shape. The other features described above in the context of the example of 1 to 4 remain applicable to this exemplary embodiment.

The expression "between . . . and . . . " must be understood as inclusive of the bounds.

The invention claimed is:

1. A patch antenna intended to equip a spacecraft, the antenna comprising:

a dielectric substrate, a radiating antenna element present on the dielectric substrate, the radiating antenna element having material defining a center of symmetry of the radiating antenna element and an area devoid of material, the center of symmetry being present in the area devoid of material, the area devoid of material being a slit and having a rectangular shape with at least two opposite edges, the antenna element having at least two opposite edges symmetrical to one another with respect to the center of symmetry, a first axis connecting the at least two opposite edges of the radiating antenna element, and a second axis extending between the at least two opposite edges of the area devoid of material and through the center of symmetry to form a non-zero angle that is less than or equal to 5° with the first axis, and a protective layer covering the radiating antenna element such that the radiating antenna element is positioned between the dielectric substrate and the protective layer, wherein the protective layer is a thermal protection layer or a space radiation protection layer.

2. The antenna as claimed in claim 1, wherein the thickness of the protective layer is less than or equal to 5 mm.

3. The antenna as claimed in claim 1, wherein the protective layer is directly in contact with the antenna element and the dielectric substrate.

4. The antenna as claimed in claim 1, wherein the antenna element comprises two truncated apices symmetrical with respect to the center of symmetry.

5. A spacecraft equipped on its external surface with at least one antenna as claimed in claim 1.

6. The spacecraft as claimed in claim 5, wherein the craft comprises on its external surface a plurality of the antennas uniformly distributed over this surface.

7. The spacecraft as claimed in claim 5, wherein the craft is a space launcher or a satellite.

8. The antenna as claimed in claim 1, wherein the protective layer is a thermal protection layer having a thermal conductivity, measured at 50° C., less than or equal to 0.3 W $m^{-1}$ $K^{-1}$.

9. The antenna as claimed in claim 8, wherein the thermal conductivity, measured at 50° C., is less than or equal to 0.2 W $m^{-1}$ $K^{-1}$.

10. The antenna as claimed in claim 1, wherein the protective layer is a space radiation protection layer, wherein a material forming the space radiation protection layer is not damaged after absorbing a dose of gamma radiation greater than or equal to 10,000 Gray.

11. The antenna as claimed in claim 10, wherein the material forming the space radiation layer is not damaged after absorbing a dose of gamma radiation of 15,000 Gray.

12. The antenna as claimed in claim 1, wherein the protective layer comprises a thermal protection layer suitable for use with a space launcher, the thermal protection layer having a thermal conductivity, measured at 50° C., less than or equal to 0.3 W $m^{-1}$ $K^{-1}$, or wherein the protective layer comprises a space radiation protection layer suitable for use with a satellite, the space radiation protection layer formed by a material that is not damaged after absorbing a dose of gamma radiation greater than or equal to 10,000 Gray.

13. The antenna as claimed in claim 1, wherein the radiating antenna element is sandwiched between the dielectric substrate and the protective layer.

14. A patch antenna, intended to equip a spacecraft, the antenna comprising:

a dielectric substrate, a radiating antenna element present on the dielectric substrate, the radiating antenna element having material defining a center of symmetry of the radiating antenna element and an area devoid of material, the center of symmetry being present in the area devoid of material, the area devoid of material being a slit and having a rectangular shape with at least two opposite edges, the antenna element having at least two opposite edges symmetrical to one another with respect to the center of symmetry, a first axis connecting the at least two opposite edges of the antenna element, and a second axis extending between the at least two opposite edges of the area devoid of material, wherein the second axis is collinear with the first axis, and a protective layer covering the radiating antenna element, wherein the protective layer is a thermal protection layer suitable for equipping the spacecraft with the patch antenna or a space radiation protection layer suitable for equipping the spacecraft with the patch antenna.

15. The antenna as claimed in claim 14, wherein the protective layer is a thermal protection layer having a thermal conductivity, measured at 50° C., less than or equal to 0.3 W $m^{-1}$ $K^{-1}$.

16. The antenna as claimed in claim 15, wherein the thermal conductivity, measured at 50° C., is less than or equal to 0.2 W $m^{-1}$ $K^{-1}$.

17. The antenna as claimed in claim 14, wherein the protective layer is a space radiation protection layer, wherein a material forming the space radiation protection layer is not damaged after absorbing a dose of gamma radiation greater than or equal to 10,000 Gray.

18. The antenna as claimed in claim 17, wherein the material forming the space radiation layer is not damaged after absorbing a dose of gamma radiation of 15,000 Gray.

19. The antenna as claimed in claim 14, wherein the protective layer comprises a thermal protection layer suitable for use with a space launcher, the thermal protection layer having a thermal conductivity, measured at 50° C., less than or equal to 0.3 W $m^{-1}$ $K^{-1}$, or wherein the protective layer comprises a space radiation protection layer suitable for use with a satellite, the space radiation protection layer formed by a material that is not damaged after absorbing a dose of gamma radiation greater than or equal to 10,000 Gray.

* * * * *